United States Patent [19]

Kenkel

[11] Patent Number: 4,555,869

[45] Date of Patent: Dec. 3, 1985

[54] REPLACEMENT WINDOWS WITH PREFORMED CORNERS

[76] Inventor: Albert Kenkel, 3112 Lawrence Dr., Edgewood, Ky. 41017

[21] Appl. No.: 584,778

[22] Filed: Feb. 29, 1984

[51] Int. Cl.[4] ..... E05D 13/04

[52] U.S. Cl. ..... 49/449; 49/501; 49/504

[58] Field of Search ..... 49/450, 504, 446, 456, 49/449, 181, 501, 180

[56] References Cited

U.S. PATENT DOCUMENTS

| | | | |
|---|---|---|---|
| 3,342,514 | 9/1967 | Ivanhoe et al. | 49/501 X |
| 3,533,190 | 10/1970 | Hilfinger et al. | 49/501 |
| 3,959,926 | 6/1976 | Noecker et al. | 49/504 X |
| 4,024,690 | 5/1977 | Collins et al. | 49/449 X |
| 4,037,378 | 7/1977 | Collins et al. | 49/449 X |
| 4,079,549 | 3/1978 | Wood | 49/453 X |
| 4,136,496 | 1/1979 | Molyneux . | |
| 4,167,835 | 9/1979 | Nobes et al. | 49/449 |
| 4,205,486 | 6/1980 | Guarnacci | 49/504 X |

*Primary Examiner*—Philip C. Kannan

*Attorney, Agent, or Firm*—Wood, Herron & Evans

[57] ABSTRACT

A replacement window is formed from extruded frame members connected by preformed corners in a manner which eliminates punch press operations typically used to form replacement windows. Preformed corner sections connect extruded horizontal and vertical frame members to form window sashes. Different preformed corners are used to connect extruded horizontal and vertical frame members to form a window frame. The preformed corners are all L-shaped with male members adapted to fit within hollow portions of the horizontal and vertical extruded members. The preformed corners used in the window sashes include any latch mechanism or guidepins required for the sash.

9 Claims, 7 Drawing Figures

REPLACEMENT WINDOWS WITH PREFORMED CORNERS

BACKGROUND

Typical methods used to manufacture double-hung replacement windows are extremely time-consuming, expensive and require a high degree of precision. Replacement windows are generally made from extrusions which form the window sash frames and the main frame of the window. These different extrusions are cut to a desired size and subjected to a series of punch press steps to permit the different extrusions to be connected together at right angles. These punch press operations also facilitate insertion of guidepins to attach the sashes to counterweight mechanisms and latch mechanisms to permit removal of the sashes. In the construction of a single double-hung window, literally dozens of punch press and cutting steps are needed. These different punch press steps and cutting steps are very time-consuming.

The punch press equipment is also extremely expensive. Several expensive dies are required to punch press each end of each extrusion, and the punch press equipment itself is extremely expensive. To operate the punch press equipment properly and manufacture a window of precise dimensions requires a careful skilled laborer. Again, this increases the cost of the window.

A second method of manufacturing windows is to use preformed corners to connect different extrusions to form the frame. For example, Collins et al U.S. Pat. No. 4,024,690 discloses the use of preformed plastic corners to form a window. The purpose of this is to maintain a thermal barrier. Construction of the window disclosed in Collins is complex and still requires multiple punch press steps.

Collins et al U.S. Pat. No. 4,037,378 discloses a method of manufacturing the main window frame of a replacement window using molded corners which reduces, but does not totally eliminate, the need to punch press the extrusions forming the main frame of the window. The purpose again is to maintain a thermal barrier. The Collins references fail to disclose or suggest a window construction which would totally eliminate the need for a punch press operation and would substantially reduce the number of saw settings used to cut the extrusions.

Further, Molyneux U.S. Pat. No. 4,136,496 discloses a sub-frame for a window which uses preformed corners. Sub-frames are not comparable to the main frame or sash frame of a window because they typically do not require large channels for counterweights, sashes or glass and do not include any latch mechanisms. The channels, latches and counterweight mechanisms originally necessitated the punch press steps. In other words, two dissimilar extrusions, such as a sill and the vertical extension of the main frame, cannot be assembled directly together without punch pressing one or both of these extrusions.

SUMMARY OF THE INVENTION

Applicant's invention is premised upon the realization that a replacement window can be constructed from extruded frame members connected by preformed molded corners wherein each corner includes all latch mechanisms and guidepin mechanisms required for that window and wherein each molded corner provides two male members adapted to be inserted into the extruded frame member to connect the extrusions and form a rectangular frame. Proper design of these corners permits window frames and sashes to be formed from extrusions of any desired cross section and wherein the extrusions need only be cut preferably a 90° angle.

Further, applicant has realized that by careful selection of the size of the corner members, all extrusions which form horizontal portions of the main frame and either sash can be the same length. Thus, when cutting extrusions, as few as three saw settings are required, one for the horizontal members, one for the vertical members of the main frame, and one for the vertical members of the upper and lower sash. This method of constructing a window saves money by eliminating the need for punch pressing equipment, reducing the required manual labor needed to assemble the window, and reducing the skill level required to assemble the window.

The advantages of the present invention will be further appreciated in light of the following detailed description and drawings in which:

DETAILED DESCRIPTION

In describing the present invention, the terms "inner", "outer", "upper" and "lower", "left" and "right" describe elements of the invention as they would be positioned when a window 20 is mounted within a wall 24 of a building and is viewed from the inside of the building.

Figure 3:
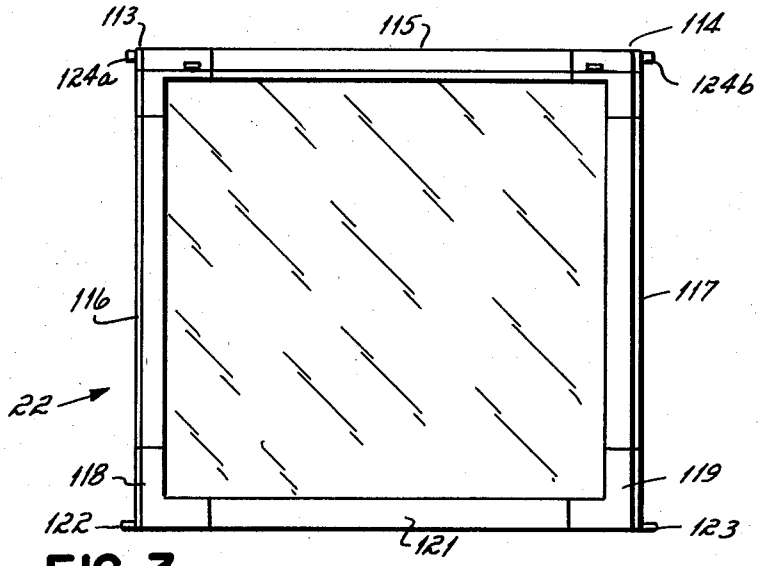
FIG. 3 is a front elevational view of an upper sash of a window viewed from the inside.
Figure 2:
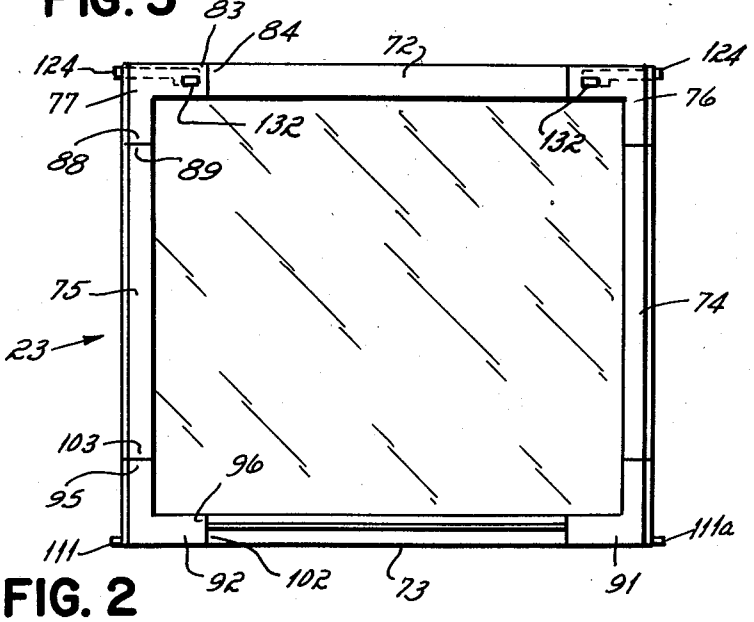
FIG. 2 is a front elevational view of an inside lower sash of a window in accordance with the present invention viewed from the inside.
Figure 1:
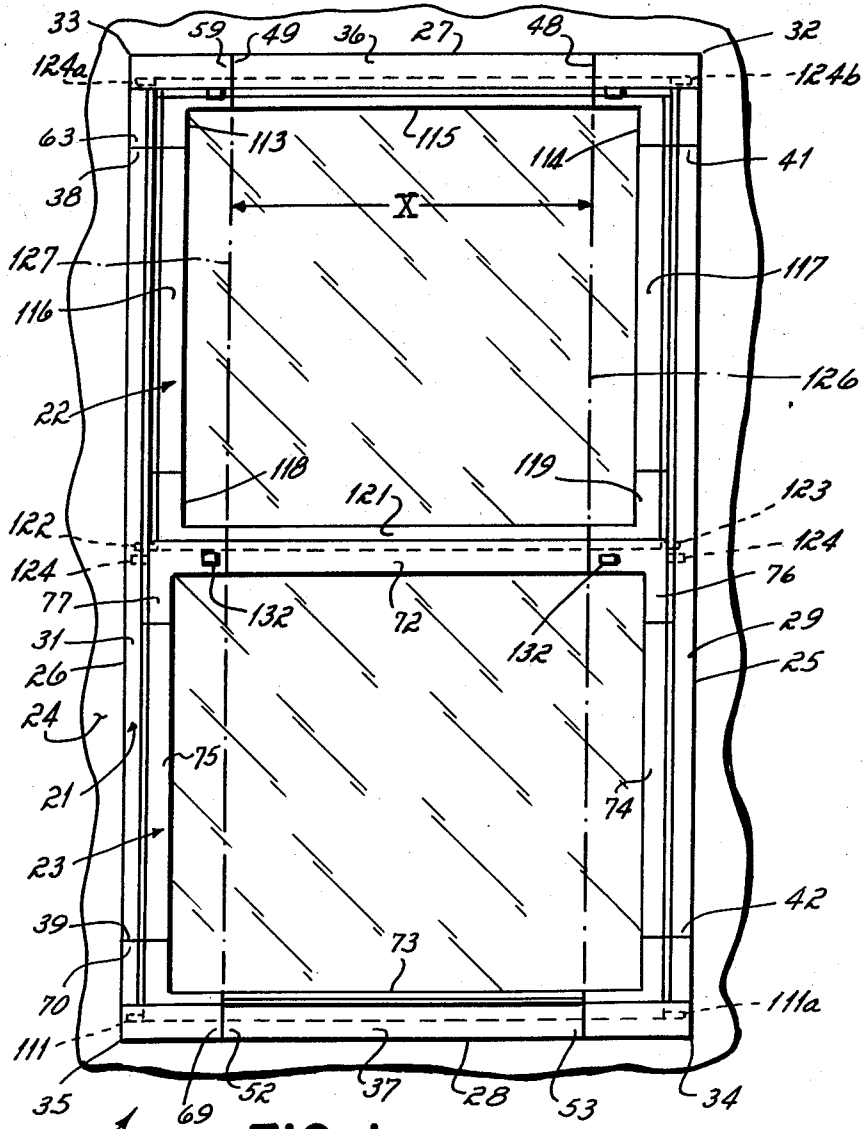
FIG. 1 is a front elevational view of the frame and window sashes as viewed from the inside of the window.

As shown in FIG. 1, window 20 has a main frame 21 and an upper or outer sash 22 and a lower or inner sash 23. The main frame 21 includes two opposed vertical members 25 and 26, an upper horizontal member or header 27, and a lower horizontal member or sill 28. The vertical members 25, 26 of the main frame 21 include mirror image extruded portions 29 and 31. Extruded portions 29 and 31 attach to individual preformed corners 32 and 33 at upper ends 41 and 38 and to individual lower preformed corners 34 and 35, respectively, at lower ends 42 and 39. The header 27 also includes an extruded portion 36 which extends between and attaches to upper preformed corners 32 and 33. The sill 28 likewise includes an extruded portion 37 extending between lower preformed corners 34 and 35.

Each of the extruded portions of the frame are formed by simply cutting a desired extrusion at 90° angles relative to the length of the extrusion to form two distal flat faces or ends. The extruded portion 31 of vertical member 26 includes upper and lower flat ends or faces 38, 39. Extrusion 29 of member 25 likewise includes two distal flat ends or faces 41 and 42. Extruded portions 29 and 31 as positioned in the main frame 21 are mirror images of each other.

Figure 6:
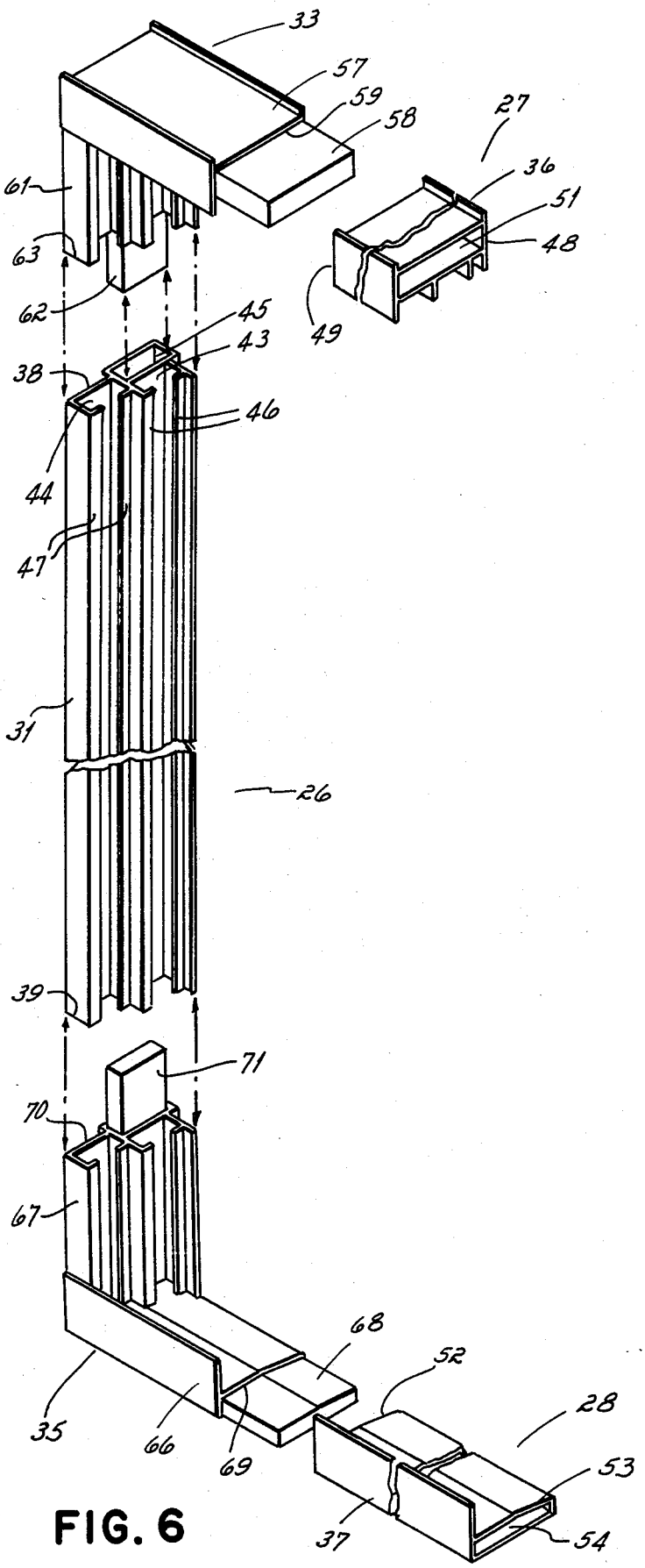
FIG. 6 is an exploded perspective view of one side of the main frame of a window, as seen from the inside, wherein horizontal and lateral extrusions are broken away.

As shown in FIG. 6, the vertical members 25 and 26 include two channels 43 and 44 which provide an area for a counterweight mechanisms 40, (only one of which is shown). Further, the extruded portions 29 and 31 include a hollow central portion 45. Above each channel 43 and 44 are ledges 46 and 47 which provide a run for upper and lower sashes 22 and 23, respectively.

The extruded portion 36 of the header is again an extrusion of desired cross sectional configuration with distal flat ends or faces 48 and 49, and includes a hollow central portion 51. The extruded portion 37 of the sill 28 is an extrusion of desired configuration having distal flat ends or faces 52 and 53. The extruded portion 37 of the sill 28 should have the same length as the extruded portion 36 of the header and likewise includes a hollow central portion 54.

The extruded portion 36 of the header is connected to the extruded portions 29 and 31 of the vertical members 25 and 26 using preformed corners 32 and 33. The preformed corners 32 and 33 are preferably injection-molded vinyl plastic corners. Corners 32 and 33 are mirror images of each other; hence, only corner 33 is illustrated in detail and described (see FIG. 6).

Corner 33 includes a first laterally extending leg 57 which terminates in a male member 58 adapted to be received within the hollow central portion 51 of the extruded portion 36 of the header 27. Once inserted, the male member is fixed within the extrusion by, for example, gluing or screwing this extruded portion to the male member. Preferably, the leg portion 57 of the upper corners includes a leading face 59 which abuts against the face 49 of the extrusion 36. Preferably, this leading face 59 of the corner should have a configuration complementary or identical to the cross sectional configuration of the extrusion 36, and in this way, mates with the extruded portion to form a continuous exterior across the entire header 27.

The corner 33 has a downwardly extending leg 61 which also includes a male member 62 adapted to fit within hollow central portion 45 of extruded portion 31. The male member 62, when inserted into the hollow portion 45 of extrusion 31, is permanently fixed to the extrusion with a face 63 of leg 61 abutting against the upper end or face 38 of the extruded portion 31. The face 63 of leg 61 has a cross sectional configuration substantially identical with the cross section of extrusions 29 and 31 to provide a continuous exterior surface along the vertical members of the frame.

The extruded portion 37 of the sill 28 is connected to extruded portions 29 and 31 of vertical members 25 and 26 at lower preformed corners 34, 35, respectively. Corners 34 and 35 are mirror images of each other, and only corner 35 is described. With reference to FIG. 6, corner 35 includes two legs 66 and 67. Leg 66 terminates at a male member 68 which fixes within the hollow central portion 54 of extrusion 37. The male member fixes within the hollow portion of the sill extrusion 37 by a means such as screws or the like with the end 52 of extrusion 37 abutted against the face 69. Face 69 complements the cross sectional configuration of the end 52 of extrusion 37. Corners 35 and 34 and sill extrusion 37 form the continuous sill 28 from upwardly extending leg 67 of corner 35 to the upward leg of corner 34.

Leg 67 of corner 35 is connected to extrusion 31 by an upwardly extending male member 71 fixed within the hollow central portion 45 of extrusion 31. A forward face 70 of leg 67 abuts against face 39 of extrusion 31 forming a continuous surface from leg 57 of upper corner 33 all the way down to leg 66 of lower corner 35.

Figure 4:
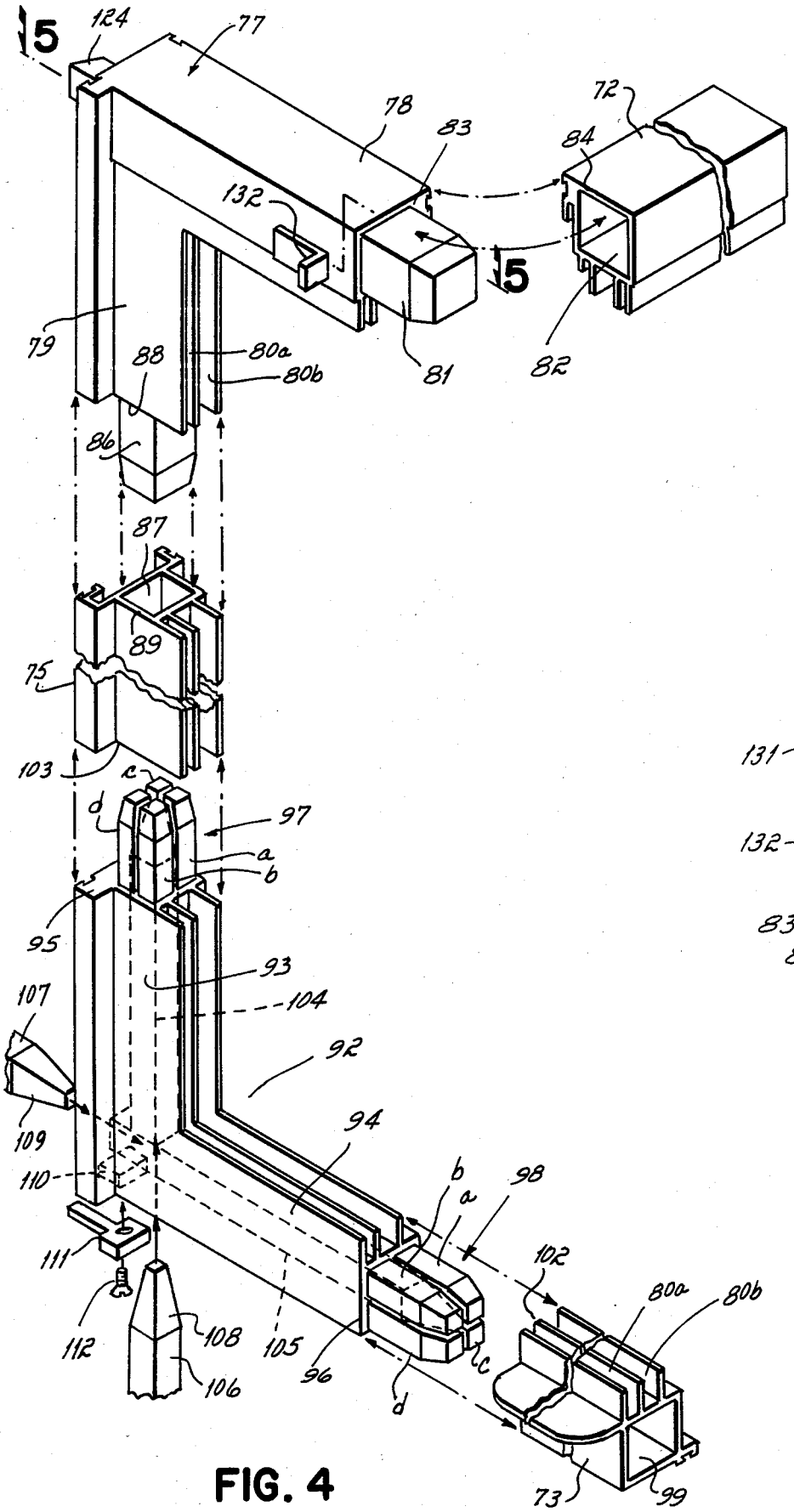
FIG. 4 is an exploded partial perspective view of the upper left and lower left corners of the lower sash, as seen from the inside.

As described, extruded portions 29, 31, 36 and 37 are connected by preformed corners 32–35 to form a continuous rectangular frame 21. As shown, there is no need to punch press any of the extruded members. The upper and lower sashes 22, 23 slide up and down on ledges 46 and 47 of the vertical members of the main frame. The sashes provide a rectangular frame to hold one or more panes of glass. As shown in FIG. 4, sash 23 provides a continuous channel **80*a* to hold one or more panes of glass. Channel 80*b*** is provided to hold muntin (not shown), if desired.

The sashes each include four extruded members connected by four preformed corners to form continuous rectangular frames. The inside or lower sash 23 includes upper and lower horizontal extrusions 72 and 73 and two mirror image oppositely opposed vertical extrusions 74 and 75. All four of these extrusions 72–75 are formed by simply cutting selected extrusions at 90° angles relative to the length of the extrusion.

The upper horizontal extrusion 72 is connected to the two vertical extrusions 74 and 75 at preformed corners 76 and 77. These corners are mirror images of each other and only the left corner 77 (FIG. 4) will be described in detail.

Corner 77 includes a horizontal leg 78 and a vertical leg 79. The horizontal leg 78 terminates in a male member 81 adapted to fit within a hollow central portion 82 of extrusion 72. Any appropriate means, such as adhesives, force fitment or set screws, may be used to maintain male member 81 in place. A forward face 83 of leg 78 abuts against end 84 of extrusion 72. The cross section of the extrusion 72 is identical to face 83, and face 83 complements end 84 to form a continuous surface from extrusion 72 to leg 78.

Likewise, leg 79 includes a male member 86 adapted to fit into hollow central portion 87 of extrusion 75. Leg 79 further includes a forward face 88 abutted against one end 89 of extrusion 75. Again, male member 86 is firmly held within the hollow section 87 of extrusion 75 by means such as a set screw or compression fit or adhesive.

Figure 5:
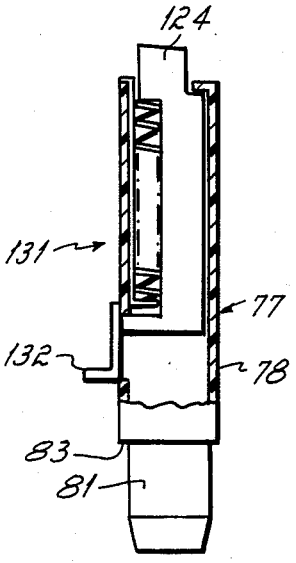
FIG. 5 is a cross sectional view taken at lines 5—5 of FIG. 4.

Corners 76 and 77 each include a latch mechanism 131 which maintains the sash attached to the main frame. The particular latch mechanism used may vary depending on desired configuration of a window. One such latch mechanism is shown in FIG. 5. This latch mechanism is of type shown and disclosed in U.S. Pat. No. 4,167,835, the disclosure of which is incorporated herein by reference. With respect to this latch mechanism, it should be noted that the latch mechanism 131 is totally held by the preformed corner. The catch 124 of the latch mechanism and thumb latch 132 extend through the corner. The extruded portions of the frame require no modification such as punch pressing to facilitate retention of the latch mechanism.

The bottom extruded member 73 is connected to vertical extrusions 74 and 75 by corners 91 and 92, thereby forming a complete rectangular frame. Corners 91 and 92 are mirror images of each other, and only corner 92 (FIG. 4) is described. Corner 92 includes an upwardly extending leg 93 and a laterally extending leg 94. Each leg 93 and 94 includes a male member 97 and 98, respectively and forward flat faces 95 and 96. Male members 97 and 98 fix within hollow central portions 99 and 87 of extrusions 73 and 75, respectively. Faces 95 and 96 complement the surface of leading ends 102 and 103 of extrusions 73 and 75.

Male members 97 and 98 are each divided into four discrete prongs 97*a-d* and 98*a-d*. Legs 93 and 94 each include a hollowed center 104 and 105 permitting wedges 106 and 107 to be forced through legs 93 and 94, respectively, up to the male members 97 and 98. Tapered ends 108 and 109 of wedges 106 and 107 force the prongs 97*a-d* and 98*a-d* outwardly. When the male members 97 or 98 are inserted into the hollow portions 87 and 99 of extrusions 75 and 73, and wedges 106 and 107 are forced through legs 93 and 94, a compression fit is formed between the male member 93 and extrusion 73 and between male member 94 and extrusion 75, respectively. Wedge 106 is slightly shorter than wedge 107 so that once wedge 106 is inserted completely through the leg member 93, clearance is provided for wedge 107.

Corner 92 includes a cavity 110 adapted to receive a guidepin 111 which can be fastened to the molded corner by means such a screw 112. Corner 91 connects and holds together extrusion 74 and 73 in the same manner as molded corner 92, and likewise includes a guidepin 111*a*.

The upper sash 22 is formed in the same manner as the lower sash. It includes four preformed corners connecting four extruded members. Upper corners 113 and 114 connect an upper extruded member 115 to vertical extruded members 116 and 117. Corners 113 and 114 like corners 77 and 76 include a latch mechanism to maintain the sash within a run in the main frame. Two lower preformed corners 118 and 119 connect vertical extrusions 116 and 117 to lower horizontal extrusion 121. Lower corners 118 and 119 like lower corners 92 and 91 of the lower sash include guidepins 122 and 123, respectively, to maintain the sash within the run in the main frame of the window.

Figure 7:
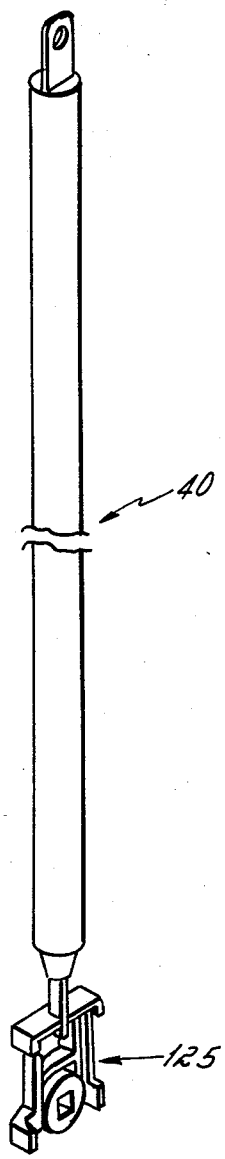
FIG. 7 is a perspective view of a spring loaded counterweight mechanism having a guide shoe attached to its lower end.

In assembled form, the sashes are attached to the main frame in a manner permitting the individual sashes to slide up and down the frame. The upper sash rides on ledge 46 with catches 124*a* and 124*b* of the latch mechanisms in channels in vertical members 26 and 29 (only channel 43 of extrusion 26 is shown). Guidepins 122 and 123 likewise ride in the same channels, preferably lodged in a guide shoe 125 (FIG. 7), which is attached to a counterweight mechanism 40. Preferably, the upper preformed corners 33 and 32 of the main frame include a boss (not shown) or other means to attach a pair of counterweight mechanisms 40 to each side of the main frame. The counterweight mechanism 40 and shoe 125 illustrated in FIG. 7 being exemplary of a typical assembly to be installed in each of the channels on each side of the frame.

Lower inner sash 23 rides on ledge 47 with catches 124*a* and 124*b* of the latch mechanisms riding in channel 44 of side members 31 and 29. Guidepins 111 and 111*a* also ride in channels in the vertical members 26 and 29 (only channel 44 shown). The pins are lodged in the guide shoes attached to the counterweight mechanisms.

As shown in FIG. 1, the horizontal extrusions cut for the header and sill of the main frame as well as the horizontal members of the upper and lower sashes may have the same length. As shown by dotted lines 126 and 127, all of these extrusions have the same length X. Basically, the horizontal legs of all of the preformed corners are provided in a length to permit one size cut for all the horizontal extrusions. This facilitates cutting each of these horizontal extrusions with one saw setting.

The preceding description is a description of the preferred embodiment of the present invention. It should be noted that applicant's invention can be used with many different types of replacement windows using different latch mechanisms, different guide mechanisms, counterweight mechanisms and the like. The embodiment disclosed takes full advantage of the present invention because a window using a latch mechanism and guidepins with a counterweight mechanism generally requires more punch press steps than windows which would not incorporate a latch mechanism or this type of counterweight mechanism.

Applicant, although having described one embodiment, intends to be bound only by the claims in which, I claim:

1. A window sash comprising first and second opposed vertical side members, a top horizontal member and an opposed bottom horizontal member, first, second, third, and fourth preformed corners connecting said side members and said top and bottom members to form a rectangular frame, said sash further including at least one latch mechanism extending from said first corner, and said latch mechanism held only by said first corner.

2. The window sash claimed in claim 1 further comprising a second latch member extending from said second corner, said latch member held only by said second corner.

3. The window sash claimed in claim 2 further including two guidepins, one each extending from said third and said fourth corners.

4. The window sash claimed in claim 1 wherein each corner comprises two legs extending at 90° angles from each other, each leg including one male portion and wherein said top, bottom and side members include hollow central portions, and wherein a male portion of each of said legs extend through an end of one of said top, bottom or side members into said hollow portions of said respective top, bottom or side members.

5. The window sash claimed in claim 4 wherein each leg includes a face abutted against an end of one of said top, bottom, or side members wherein each face complements the end of the member it abuts.

6. A window sash including four extruded members, each member including a hollow central portion and two flat distal ends, said members connected by a first, second, third and fourth preformed corners to form a rectangular frame, each corner including two legs, each leg including the male portion fitted through one end of said member into that member's hollow central portion, wherein said first and said second corners each include a latch mechanism, each latch mechanism held only by said corners.

7. The window sash claimed in claim 6 wherein said third and fourth corners each include a guidepin.

8. A double-hung window having a first sash, a second sash and a master frame;

said first sash including first and second opposed side members, a top and an opposed bottom member, four separate preformed corners connecting said side members and said top and bottom members to form a rectangular frame, and wherein said second sash comprises first and second opposed side members, a top and an opposed bottom member, four separate preformed corners connecting said side members and said top and bottom members to form a rectangular frame;

said master frame including first and second opposed side members, a top and an an opposed bottom member, four separate preformed corners connecting said side member and said top and bottom members to form a rectangular frame;

said first and said second sashes being maintained in a sliding relationship within said master frame; and wherein said top and bottom members of said first sash, said second sash and said main frames are of equal length;

wherein two corners of each sash include a latch mechanism, said latch mechanisms held only by said corners.

9. A window sash frame comprising two opposed horizontal members and two opposed vertical members;

said horizontal and vertical members connected by four corner members, each corner member connecting one vertical member to one horizontal member at a 90° angle;

wherein each horizontal member and each vertical member are formed from extrusions by cutting straight through said extrusion to form a first flat end and by cutting straight through said extrusions to form a second distal flat end, each member having a hollow central portion;

wherein each corner member has two leg portions, each leg portion including a male member fitted within the hollow central portion of said horizontal or said vertical members;

wherein two of said corners include a guide pin adapted to connect to counterbalance mechanisms; and wherein two of said corner members include a latch mechanism, said latch mechanism extending through one edge of said corner and adapted to fit within a channel in a main window frame and wherein said latch mechanisms are held only by said corners.

* * * * *